United States Patent [19]

Bean

[11] 4,262,575

[45] Apr. 21, 1981

[54] QUASI-RANDOM PHASE SHIFT SYSTEM FOR AN ELECTRONIC MUSICAL INSTRUMENT

[75] Inventor: Eric R. Bean, South Bend, Ind.

[73] Assignee: Kimball International, Inc., Jasper, Ind.

[21] Appl. No.: 143,471

[22] Filed: May 7, 1980

Related U.S. Application Data

[63] Continuation of Ser. No. 834,245, Sep. 19, 1977, abandoned.

[51] Int. Cl.[3] ..... G10H 1/02

[52] U.S. Cl. ..... 84/1.24; 84/DIG. 4

[58] Field of Search ..... 84/1.01, 1.24, DIG. 4

[56] References Cited

U.S. PATENT DOCUMENTS

| | | | |
|---|---|---|---|
| 3,809,787 | 5/1974 | Mochida | 84/1.01 |
| 3,978,755 | 9/1976 | Woron | 84/1.24 |
| 4,056,995 | 11/1977 | Uetrecht | 84/1.01 |

*Primary Examiner*—J. V. Truhe
*Assistant Examiner*—Forester W. Isen
*Attorney, Agent, or Firm*—Albert L. Jeffers; John F. Hoffman

[57] ABSTRACT

An electronic musical instrument employing top octave synthesizer circuits (TOS circuits) for generating the musical tones to be reproduced by the instrument employs a single master oscillator common to all of the top octave synthesizer circuits for supplying the trains of clock pulses to the synthesizer circuits for their operation. To prevent phase-locked conditions from existing in the frequencies produced by different synthesizers, the clock pulses from the master oscillator are supplied to the synthesizers through coincidence gate logic circuitry which is controlled by means of a low frequency oscillator and a divider or shift register circuit to delete different ones of the clock pulses from the clock pulse signal trains for each of the different synthesizers. This causes all of the frequencies obtained from the synthesizers to be slightly different from one another, independent, and not phase-locked. This nonphase-locked system provides a more pleasing musical effect than is otherwise attainable from a top octave synthesizer system using a single master oscillator to drive more than one top octave synthesizer circuit.

7 Claims, 2 Drawing Figures

QUASI-RANDOM PHASE SHIFT SYSTEM FOR AN ELECTRONIC MUSICAL INSTRUMENT

This is a continuation of application Ser. No. 834,245, filed 9/19/77, now abandoned.

BACKGROUND OF THE INVENTION

Electronic musical instruments such as electronic organs presently generally employ divider circuitry known as "top octave frequency synthesizers" for generating twelve output signals which have the frequencies corresponding to the musical tones of the highest octave of the instrument. These output signals then are divided down by simple divider circuits to provide musical tones of the next highest octave and so on through all of the octaves for the lower octaves which are capable of production by the organ or other electronic musical instrument.

The frequencies of the tones produced in each of the octaves by such a system are accurate and are accurately octavely related to one another. A problem exists, however, in that the phase relationships of the tones in each of the octaves from a single top octave synthesizer are precisely locked in phase. The result of this is musically unpleasant and unnatural, and at times can result in the loss of certain notes or tones which the musician desires to have reproduced. For example, it is possible to play an 8′ and a 4′ flute, play octaves and hear only the lowest and highest note, the middle note being completely cancelled out by one keyer being on when the other is off. This would be the situation when the harmonics of the notes are subtractive. On the other hand, the harmonics can be additive which would unnaturally emphasize the middle note.

A solution to the problem of phase-locked tones in top octave synthesizer systems has been to provide a number of top octave synthesizers, equal to each of the maximum number of tones which are likely to be produced by the musical instrument at any one time, and to have independent oscillators providing the source of clock pulses or drive signals for each different top octave synthesizer in the instrument. In such a system, twelve high-frequency stable oscillators, such as crystal oscillators, are required for each keyboard if the maximum possibility or probability of notes from the instrument at any one time is equal to twelve. Even so, care must be taken that two or more of these oscillators do not become phase-locked to one another; and this is difficult and expensive to implement.

It is desirable to provide a top octave synthesizer system for an electronic organ or electronic musical instrument which produces an output chorus tone effect comparable to the effect obtained from sounding corresponding tones by means of different musical instruments. When tones produced by different musical instruments are combined in an orchestra, the various tones are not precise harmonics of one another but differ slightly, which produces a pleasing natural chorus tonal effect to the listener.

Accordingly, it is desirable to produce a tonal effect in an electronic organ employing top octave synthesizers which simulate this more natural imprecise harmonic effect to the listener and which utilizes a minimum number of precision oscillators.

SUMMARY OF THE INVENTION

Accordingly, it is an object of this invention to provide an improved control system for the generation of tones in an electronic musical instrument.

It is another object of this invention to provide an improved top octave synthesizer system for use in electronic musical instruments.

It is an additional object of this invention to provide a top octave synthesizer for an electronic musical instrument which employs a single precision oscillator and which insures that different top octave synthesizers in the instrument are not phase-locked to one another.

It is a further object of this invention to provide a quasi-random phase shift system for use between a precision oscillator and the inputs of several top octave synthesizer divider circuits in an electronic musical instrument to insure that the outputs of the different top octave synthesizer dividers are not phase-locked to one another.

In accordance with a preferred embodiment of this invention, an electronic musical instrument utilizes several top octave frequency synthesizers to permit the simultaneous production of different tones from the instrument. A common source of clock pulses is provided by a high frequency oscillator for operating each of the frequency synthesizers; and a circuit is coupled between the source of clock pulses and at least one of the frequency synthesizers for varying the number of clock pulses applied to the different frequency synthesizers over a fixed interval of time from the number of clock pulses applied to others of the frequency synthesizers over the same fixed interval of time. In a more specific application, this is accomplished by deleting selected ones of the clock pulses from the source of pulses prior to application of the train of clock pulses to the different frequency synthesizers.

DETAILED DESCRIPTION OF THE PREFERRED EMBODIMENT

Figure 1:
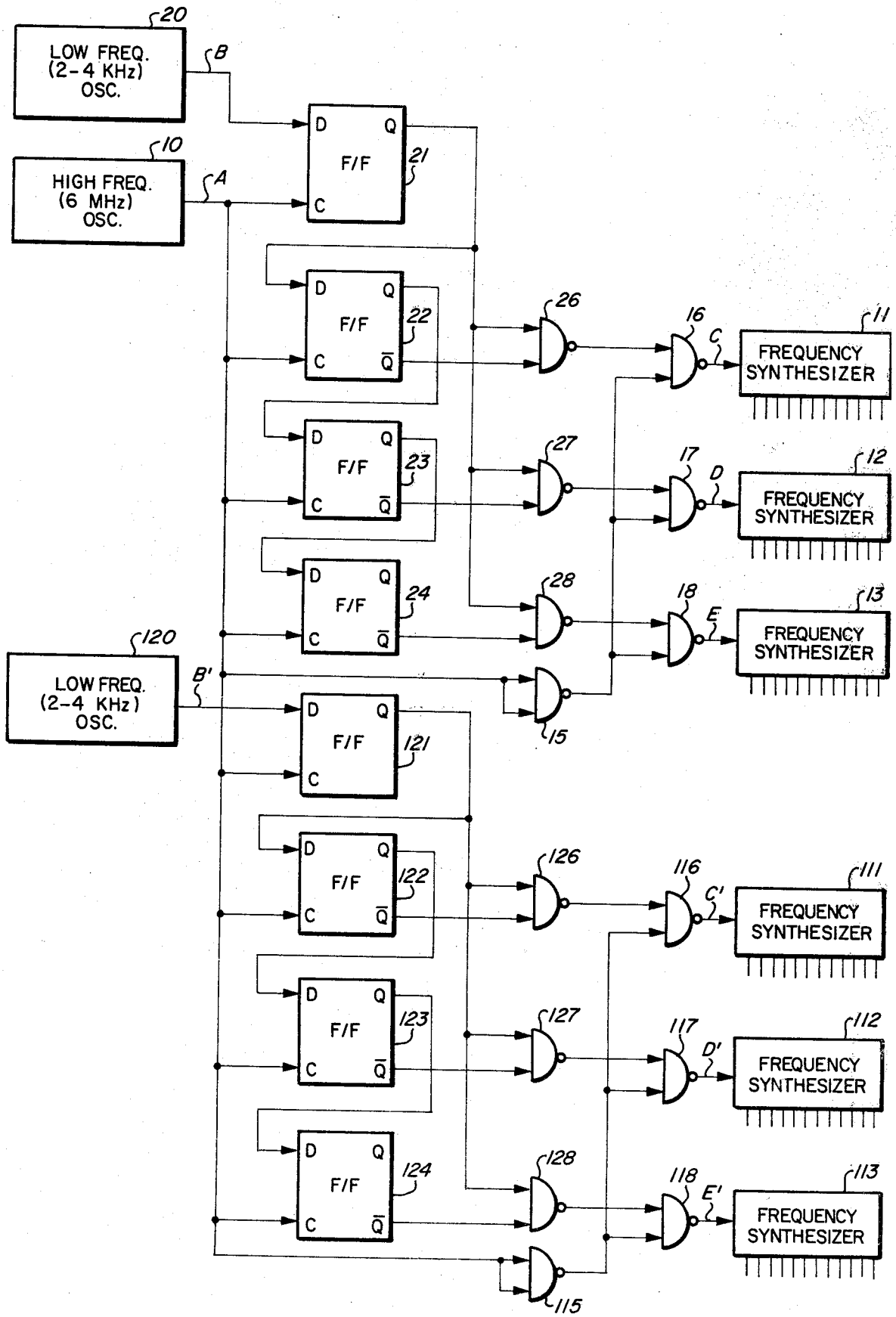
FIG. 1 is a block diagram of a preferred embodiment of the invention.
Figure 2:
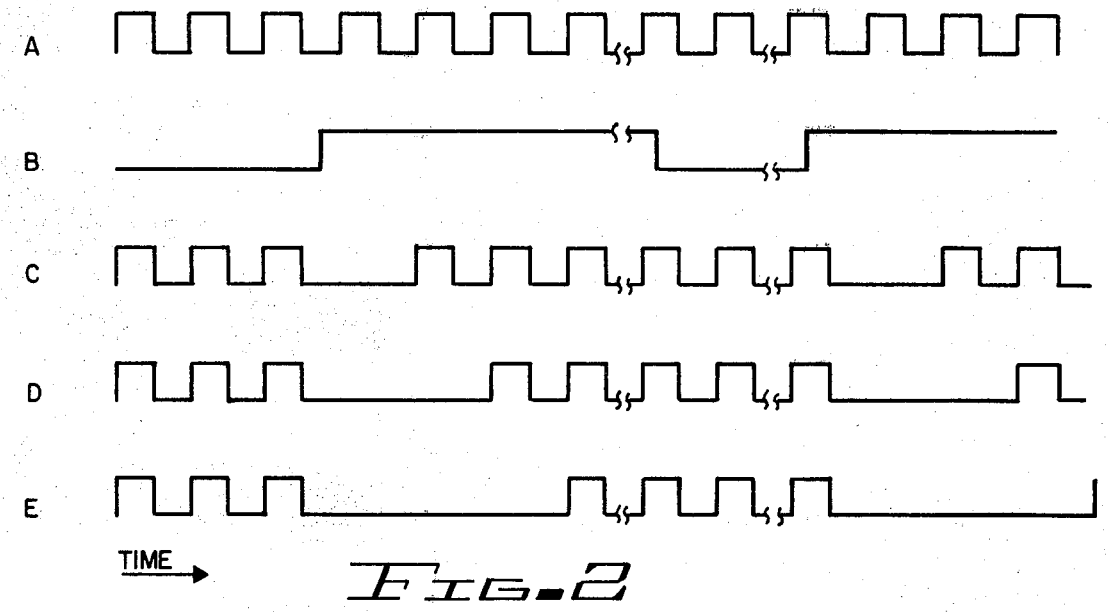
FIG. 2 illustrates waveforms useful in explaining the operation of the circuit shown in FIG. 1.

Referring now to the drawings, FIG. 1 illustrates a block diagram of a system in accordance with a preferred embodiment of this invention. Various points in the circuit of FIG. 1 are labeled with the letters A through E and these letters correspond, respectively, to the waveforms A through E of FIG. 2 which are representative of the signals appearing at the similarly labeled points in FIG. 1. In the circuit of FIG.. 1, a stable high frequency oscillator 10, which may be a crystal oscillator or other highly stable oscillator circuit, produces a sequence of clock pulses A on its output. These clock pulses constitute the basic frequency which is used to operate all of six top octave frequency synthesizer circuits 11, 12, 13 and 111, 112 and 113 shown in FIG. 1. Both the oscillator 10 and the frequency synthesizers 11 through 13 and 111 through 113 are conventional circuits normally employed in electronic musical instruments, such as electronic organs.

Each of the synthesizers 11 through 13 and 111 through 113 has twelve outputs which correspond to the twelve frequencies of an even tempered scale for the highest octave of the instrument. Each of the synthesizers 11 through 13 and 111 through 113, in conjuction with octave division circuitry connected to their outputs, are used to produce any note which the organ can produce. The manner in which the different top octave synthesizers are assigned to particular keys for the production of particular tones in the organ is not important to the present disclosure and may be accomplished by multiplexing techniques or other techniques which are known in the art.

Typically, the clock pulse output A from the high frequency oscillator 10 is several megahertz and has been illustrated in FIG. 1 as 6 MHz by way of example. The particular frequency is not significant except to the extent that the dividers in the frequency synthesizers 11 through 13 and 111 through 113 must be selected to produce the desired output frequencies for the top octave of the instrument in accordance with whatever frequency is selected for the oscillator 10. The high frequency oscillator 10 is the only highly stable oscillator required for the system, and a single oscillator 10 may be used to drive as many as twelve or more top octave synthesizers used in the organ.

To prevent phase-lock of the signals obtained from the frequency synthesizers 11 through 13 and 111 through 113, the output of the high frequency oscillator 10 is applied to the frequency synthesizers 11, 12 and 13 through a NAND gate inverter 15 to the lower input of three two-input NAND gates 16, 17 and 18, the putputs of which are connected respectively to the clock pulse inputs of the frequency synthesizers 11, 12 and 13. Similarly, the output of the oscillator 10 is applied through a NAND gate inverter 115 to three NAND gates 116, 117 and 118, the outputs of which are respectively connected to the clock inputs of the frequency synthesizers 111, 112, and 113.

So long as each of the NAND gates 16, 17 and 18, and 116, 117 and 118 are enabled by the signals appearing on their upper inputs, all of the clock pulses supplied to them through the NAND gate inverters 15 and 115 are passed through to their outputs to operate as clock pulses for the respective frequency synthesizers to which they are connected. In order to derive tone frequencies from the synthesizers which are slightly different from one another (that is essentially different in phase but not in detectable frequency to the human ear) inhibit signals are applied at different various times for different durations to the upper or control inputs of the NAND gates 16, 17 and 18 and 116, 117 and 118. The manner in which this is done is described below in detail with respect to the NAND gates 16, 17 and 18, and it is to be understood that the same description also is applicable to the control of the NAND gates 116, 117 and 118.

As is well known, the 6 MHz signal from the oscillator 10 is divided down by divider circuitry within each of the frequency synthesizers 11 through 13 and 111 through 113 to cause the twelve outputs from each of the synthesizers to vary within one octave in a tonal range which is in the low kilohertz frequency region. Thus, a variation of one or two pulses from the 6 MHz oscillator over a fixed period of time constituting a small fraction of a second is essentially not detectable to the human ear, but it is sufficient to prevent the outputs from the frequency synthesizers 11, 12 and 13 and 111, 112 and 113 from becoming phase-locked with one another. This desired objective is accomplished by the provision of a low frequency (two to four kHz) free-running oscillator 20, which produces an output waveform as illustrated in waveform B of FIG. 2.

The low frequency oscillator 20 need not be a stable oscillator. In fact the particular frequency of oscillation is unimportant and it can vary substantially without any adverse effect on the operation of the circuit. Preferably, the oscillator 20 is independent of the high frequency oscillator 10; but if desired, the signals obtained from the oscillator 20 could be derived by means of divider circuitry connected to the output of the high frequency oscillator 10. Ideally, however, the oscillator 20 is wholly independent of the stable high frequency oscillator 10.

The signals supplied from the output of the low frequency oscillator 20 operate as input signals supplied to the input of the first stage of a divider circuit in the form of a four-stage shift register comprised of four flip-flops 21, 22, 23 and 24. The different stages of the flip-flops 21 to 24 are interconnected in a conventional manner by connecting the Q outputs of each stage to the D signal input of the next succeeding stage. Shift pulses for the shift register comprised of the flip-flops 21 through 24 are obtained from the output of the high frequency oscillator 10 and are shown in FIG. 1 as supplied to the C inputs of each of the flip-flops in the shift register. In the circuit of FIG. 1, the Q output of the input stage 21 of the shift register is connected to the upper one of the inputs of three two-input NAND gates 26, 27 and 28. The outputs of these NAND gates constitute the control or inhibit inputs for the NAND gates 16, 17 ad 18, respectively. So long as these outputs are "high", the NAND gates 16, 17 and 18 pass an inverted version of whatever pulse signals are applied to their lower inputs to the corresponding frequency synthesizers 11, 12 and 13. Whenever the putputs of any of the NAND gates 26, 27 or 28 are low, the corresponding NAND gate 16, 17 or 18 to which such a gate is connected is inhibited from passing any pulses through it and maintains a low output for so long as the output of the control NAND gate connected to it 26, 27 or 28 remains low.

Normally, the outputs of the NAND gates 26, 27 and 28 are high, so that the gates 16, 17 and 18 are not inhibited and pass all pulses applied to their inputs from the output of the inverter 15. whenever a positive output, however, appears in the low frequency clock signal waveform B from the output of the low frequency oscillator 20, the next clock pulse applied to the flip-flop 21 causes its Q output to go "high". Just prior to such a positive going transition from the output of the oscillator 20, all stages of the shift register 21 through 24 were set so that the Q outputs were "low" and the $\overline{Q}$ outputs were "high". Thus, since at least one of the inputs to each of the NAND gates 26, 27 and 28 was "low", the outputs of all of these NAND gates were "high" enabling the corresponding NAND gates 16, 17 and 18 to pass the lock pulses applied to their other inputs. When the Q output of the flip-flop 21 goes "high", however, both of the inputs to all three of the NAND gates 26, 27 and 28 are "high"; so that all three outputs go low, inhibiting the passage of the next clock pulse from the output of the inverter 15 through all three of the NAND gates 16, 17 and 18. Thus, a pulse is deleted from the pulse signal train applied to the inputs of each of the three frequency synthesizers 11, 12 and 13. This is shown in each of the waveforms C, D and E of FIG. 2.

Since the frequency of the oscillator 20 is several orders of magnitude lower than the frequency of the clock pulses applied from the output of the oscillator 10, a large number of clock pulses from the oscillator 10 appear during each positive half cycle of the output of the low frequency oscillator 20. Thus, the next shift pulse which is obtained from the output of the oscillator 10 causes the information stored in the flip-flop 21 to be transferred to the flip-flop 22; but the flip-flop 21 still has a positive signal applied to its D input so the Q output of the flip-flop 21 remains "high". The shifting of this information into the flip-flop 22 however, causes the Q output of the flip-flop 22 to go "high" and its $\overline{Q}$ output to go "low". As a result, the output of the NAND gate 26 once again goes "high" (since one of its two inputs is low) and the NAND gate 16 is permitted to resume the passage of the clock pulses through it to the frequency synthesizer 11. This is shown in waveform C by the resumption of the clock pulses after an interruption or a deletion of one clock pulse from the pulse train sequence. At this time, however, the outputs of both of the NAND gates 27 and 28 remain "low"; so that a second clock pulse is inhibited or blocked from passage by the NAND gates 17 and 18 from the sequence of clock pulses applied to the frequency synthesizers 12 and 13.

The third clock pulse from the oscillator 10 in the sequence following the initiation of the positive half-cycle of the waveform from the oscillator 20 causes the information to be shifted into one more stage, so that the first three stages 21, 22 and 23 of the shift register now store the positive signal and have a "low" output potential on their $\overline{Q}$ outputs. Thus, the NAND gates 26 and 27 supply "high" enabling signals to the NAND gates 16 and 17 which pass the clock pulses from the high frequency oscillator 10; but the NAND gate 28 continues to have a "low" output inhibiting the passage of the third clock pulse in the sequence through the NAND gate 18.

The fourth pulse from the output of the oscillator 10 in the sequence then causes all four stages of the shift register to store the positive or "high" output from the low frequency oscillator 20. This in turn enables all three of the NAND gates 16, 17 and 18, irrespective of the remaining duration of the positive output from the low frequency oscillator 20. From an examination of FIG. 2, it can be seen that the waveforms C, D and E have one, two and three clock pulses from the high frequency oscillator 10 deleted from them, respectively, during this positive half cycle of the clock pulse or square-wave signal obtained from the output of the low frequency oscillator 20.

When the output of the low frequency oscillator 20 resumes back to its negative half cycle, no change in the status of the output gates 26, 27 and 28 occurs since any low signal applied to any of the inputs of these NAND gates forces a "high" output to be obtained from the gates. The next time that a positive half cycle in the signal waveform B from the oscillator 20 occurs, the foregoing sequence of operation is repeated.

The result of this circuit operation is that different numbers of clock pulses have been removed from the clock pulse signal train applied to the three frequency synthesizers 11, 12 and 13 periodically as determined by the frequency of the low frequency oscillator 20. The divider circuitry within each of the synthesizers 11, 12 and 13 plus the averaging which is produced by the human ear renders the effect of these missing pulses essentially nondetectable so far as the frequency of the tones produced by the frequency synthesizers 11, 12 and 13 are concerned. The deletion of these different numbers of selected pulses during fixed intervals of time of operation of the circuit, however, insures that the outputs of the frequency synthesizers 11, 12 and 13 are not in phase and in fact insures that these signal outputs will not accidentally ever be in phase with one another. Thus, no audibly unpleasant phase-lock cancellations can occur even though only a single master clock oscillator is used for the entire system.

If only one group of frequency synthesizers were to be controlled by the low frequency oscillator 20 in the manner described above, the output of the high frequency oscillator 10 could also be supplied directly, without the intervening logic gate circuitry, to a fourth frequency synthesizer since the input to such a fourth frequency synthesizer would gave a different number of clock pulses applied to it from the oscillator 10 over each fixed interval of time from the number of clock pulses applied to the inputs of each of the other synthesizers 11, 12 and 13.

As illustrated in FIG. 1, however, the high frequency oscillator is used to supply clock signals to other groups of frequency shythesizers, one more of which has been illustrated as the synthesizers 111, 112 and 113. To permit a modular approach to adding different groups together without ever having any of the synthesizers phase-locked with one another, the inputs to all of the synthesizers are illustrated as passing through the NAND gate logic circuit, so that none of the synthesizers are supplied directly with the output of the high frequency oscillator 10.

To insure that the outputs of the frequency synthesizers 111, 112 and 113 are not in phase, that is are non-phase-locked, with the outputs of the frequency synthesizers 11, 12 and 13, a second low frequency oscillator 120 is used to supply input signals to a second shift register comprised of four flip-flops 121, 122 123 and 124. These four flip-flops correspond in operation and function to the flip-flops 21, 22, 23 and 24, the operation of which has been described in detail above. Similarly, three control NAND gates 126, 127 and 128 are connected to the outputs of the shift register stages 122 through 124; and these NAND gates operate in the same manner as the NAND gates 26, 27 and 28 described in detail above.

When the low frequency oscillator 120 is independent of the low frequency oscillator 20, the particular times at which pulses are deleted from the inputs to the frequency synthesizers 111, 112 and 113 differ from the times when pulses are deleted from the inputs to the synthesizers 11, 12 and 13; so that the nonphase-locked condition of operation is insured. It is readily apparent that if the oscillators 20 and 120 are nonstable and vary randomly in frequency with respect to one another and with respect to ambient conditions, the nonphase relationship of operation of the frequency synthesizers is even further enhanced. For this reason, the cost of implementing the oscillators 20 and 120 in any given circuit is relatively low since there is no requirement on these oscillators that they have any critical frequency operation. This cost is much less than the cost of a stable oscillator, such as the oscillator 10.

It has been found that groups of three frequency synthesizers and the appropriate logic and control circuitry for operating these synthesizers as described above are a convenient package for implementation, on a modular basis, of the desired number of synthesizers for a given organ or a keyboard within an organ. Typically, a single high frequency oscillator 10 is used to drive as many as twelve different frequency synthesizers (four groups such as the two groups shown in FIG. 1). The cascading of additional groups to the circuitry shown in FIG. 1 is accomplished in the same manner as described above for the two groups of frequency synthesizers 11 through 13 and 111 through 113.

While the foregoing description has been directed to the specific embodiment shown in FIG. 1, the technique which has been employed, that is of deleting different numbers of the pulses of the clock pulse signal train A from the high frequency oscillator 10 before applying the pulses to the frequency synthesizers can be effected by circuitry other than the shift register circuitry illustrated in FIG. 1. For example, this deletion of different numbers of pulses from the inputs to the different frequency synthesizers also can be accomplished by divider circuits having different division ratios for the outputs connected to the control inputs of the control NAND gates such as the NAND gates 26, 27 and 28, for example.

The implementation of the circuit in the specific form shown in FIG. 1, therefore, is to be considered merely as illustrative of the principles of the invention and not limiting the true scope of the invention. Various modifications and equivalent applications of the concept of this invention will occur to those skilled in the art without departing from the true scope of the invention as set forth in the following claims.

I claim:

1. In an electronic musical instrument (a) a source of relatively high frequency signals and a source of relatively low frequency signals;

(b) a plurality of frequency synthesizer means for producing a plurality of output signals each having frequencies at least as high as the upper octave note tones of the instrument;

(c) means for producing a plurality of different pulse trains of different particular frequencies, the frequency of each pluse train being substantially equal to that of the relatively high frequency signals and to each other, the frequency of each of the pulse trains being equal to that of the relatively high frequency signals except that one train has n pulses deleted, a second train has n plus at least one pulse deleted, a third train has n plus at least two pulses deleted for each cycle of the low frequency signal source, n being a poistive integer ($n=1,2,3\ldots$);

(d) means connecting the sources of high and low frequency signals to the producing means, and means connecting the producing means to the frequency synthesizer means with different pulse trains being connected to different frequency synthesizers.

2. A musical instrument as in claim 1 wherein the producing means includes means for gating the high frequency signals from the high frequency source to the frequency synthesizers with each gating means being operatively responsive to the high frequency source;

means for disabling the gating means so as to delete predetermined numbers of pulses from the high frequency signals passed by the gating means, the disabling means being connected to the high and low frequency signal sources and to the gating means, the disabling means including a chain of bi-stable elements with each element being activated in response to successive signals from the high frequency signal source.

3. In a electronic musical instrument (a) a source of relatively high frequency signals and a source of relatively low frequency signals;

(b) a plurality of frequency synthesizer means for producing a plurality of signals each havng frequencies at least as high as the upper octave note tones of the instrument;

(c) means for deleting pulses from the high frequency signals (i) said deleting means having a plurality of parallel stages;

(ii) means in each stage for deleting a different number of successive pulses from the high frequency signals each cycle of the lower frequency source and producing a plurality of parallel signal trains of equal frequency but with said different numbers of successive pulses deleted.

(d) means connecting the parallel stages of the pulse deleting means to successive ones of the frequency synthesizer.

4. A musical instrument in accordance with claim 3 wherein each stage of the pulse deleting means includes a bi-stable element having an input connected directly to the source of high frequency signals and an input connected to an output of the preceding stage.

5. A musical instrument in accordance with claim 4 wherein each stage includes a gate means having one input connected to an output of the bi-stable element and one input connected to the source of high frequency signals and an output connected to a frequency synthesizer.

6. In an electronic musical instrument (a) a source of relatively high frequency signals and a source of relatively low frequency signals;

(b) at least a first and a second frequency synthesizer means for producing a plurality of output signals each having frequencies at least as high as the upper octave note tones of the instrument;

(c) at least a first and a second gate connected to the first and second synthesizers respectively;

(d) means connected between said source of relatively high frequency signals and said gate, for applying signals of the same relatively high frequency to one input of each gate.

(e) means connected to another input of each gate, for disabling the first and second gate for a first and second period of time each cycle of said relatively low frequency source, said first and second time periods commencing simultaneously with each other and with the second period terminating subsequent to said first period by an amount of time corresponding substantially to a cycle of said high frequency source.

7. In a musical instrument (a) at least a first and a second multi-stage pulse deletion means;

(c) a first single relatively low frequency signal source connected to the first pulse deletion means and a second single relatively low frequency signal source connected to the second pulse deletion means;

(c) a single relatively high frequency signal source connected in parallel to both the first and the second pulse deletion means;

(d) each stage of the first and second multi-stage deletion means including a gate and means for disabling the gates in each deletion means for different periods of time, the periods of time commencing simultaneously within each respective deletion means but having durations of increasing magnitude dependent upon stage, the gates of the first pulse deletion means being disabled for said different periods of time each cycle of said first low frequency source and the gates of the second pulse deletion means being disabled for said different periods of time each cycle of said second low frequency source;

(e) means for applying to an input of said gate signals of indentical frequencies from said high frequency signal source;

(f) a plurality of frequency synthesizers connected to the outputs of said gates for producing output signals each having frequencies at least as high as the upper octave note tones of the instrument.

* * * * *